US009908692B2

(12) United States Patent
Corbin

(10) Patent No.: US 9,908,692 B2
(45) Date of Patent: Mar. 6, 2018

(54) MULTI-PIECE STORAGE TANK PAD WITH SEPARATE CONNECTORS

(71) Applicant: ASFI Partners, L.P., Sanger, TX (US)

(72) Inventor: Chad Edwin Corbin, Sanger, TX (US)

(73) Assignee: ASFI Partners, L.P., Sanger, TX (US)

( * ) Notice: Subject to any disclaimer, the term of this patent is extended or adjusted under 35 U.S.C. 154(b) by 0 days.

(21) Appl. No.: 15/148,800

(22) Filed: May 6, 2016

(65) Prior Publication Data

US 2016/0326710 A1 Nov. 10, 2016

Related U.S. Application Data

(60) Provisional application No. 62/157,906, filed on May 6, 2015.

(51) Int. Cl.
*E02D 27/00* (2006.01)
*B65D 90/12* (2006.01)

(52) U.S. Cl.
CPC ..... *B65D 90/12* (2013.01)

(58) Field of Classification Search
CPC .. E02D 27/02; E02D 2300/0046; B65D 90/12
USPC ..... 52/292
See application file for complete search history.

(56) References Cited

U.S. PATENT DOCUMENTS 779,536 A * 1/1905 Derry et al. ..... E04F 15/02 52/311.2
886,077 A * 4/1908 Rowe ..... B25B 5/006 108/62
1,436,896 A * 11/1922 Newell ..... E01C 5/08 404/40
1,614,127 A * 1/1927 Heppes ..... E04F 15/10 52/311.2
2,194,653 A * 3/1940 Gell ..... A47G 27/0218 15/215

(Continued)

FOREIGN PATENT DOCUMENTS

EP 542605 A1 5/1993
EP 467050 B1 4/1994

(Continued)

OTHER PUBLICATIONS

*Falcon Technologies and Services, Inc.* vs. *All Seasons Foam Coatings & Services LLC*, Complaint for Patent Infringement, Case No. 4:15-cv-00916, filed Apr. 8, 2015.

(Continued)

*Primary Examiner* — Basil Katcheves
*Assistant Examiner* — Joshua Ihezie
(74) *Attorney, Agent, or Firm* — Gardere Wynne Sewell LLP

(57) ABSTRACT

A multi-piece storage tank pad is configured to support a storage tank used in oilfield operations. The multi-piece pad includes a plurality of pad pieces where each pad piece has a core coated with a polymeric coating. Each pad piece also defines at least two connector receiving contours. Two pad pieces of the multi-piece pad are joined by a connector. Each connector also has a core that is coated with the polymeric coating. Each connector is separate from the plurality of pad pieces, and each has a shape that corresponds to two adjacent connector receiving contours.

8 Claims, 7 Drawing Sheets

(56) References Cited

U.S. PATENT DOCUMENTS 2,257,001 A * 9/1941 Davis ..... B28B 1/002 211/182
2,595,111 A * 4/1952 Steward ..... A47G 27/0481 24/703.1
2,680,698 A * 6/1954 Schnee ..... E04F 15/10 15/215
2,999,431 A * 9/1961 Mitchell ..... E01C 13/045 404/32
3,425,586 A * 2/1969 Petters ..... B65D 21/0201 220/23.4
3,686,817 A * 8/1972 Adams ..... F16B 5/0052 52/438
4,023,596 A * 5/1977 Tate ..... B29C 65/58 138/103
4,115,980 A * 9/1978 Martel ..... E04B 2/46 446/124
4,355,844 A 10/1982 Muzzarelli
4,359,294 A * 11/1982 Crillesen ..... F16B 5/0052 403/231
4,430,837 A * 2/1984 Kirschenbaum ..... E04F 15/02 404/40
4,474,504 A * 10/1984 Whitman ..... E02B 3/14 404/40
4,571,910 A * 2/1986 Cosentino ..... E04F 13/0892 52/391
4,660,345 A 4/1987 Browning
4,697,294 A * 10/1987 Schafer ..... E01O 5/005 14/69.5
RE32,663 E * 5/1988 Atkinson ..... E02B 3/14 404/40
4,765,775 A 8/1988 Kroger
4,802,322 A 2/1989 Bendfeld
4,865,899 A 9/1989 Reichert
4,867,608 A 9/1989 Kinghorn
4,911,326 A 3/1990 McGrouran
4,917,537 A 4/1990 Jacobson
5,020,667 A 6/1991 Bush
5,030,033 A 7/1991 Heinzelman et al.
5,090,835 A * 2/1992 Cox ..... A47G 1/10 40/782
5,098,220 A 3/1992 Norman
5,265,976 A 11/1993 Russell
5,281,055 A * 1/1994 Neitzke ..... E02B 3/064 114/263
5,317,076 A 5/1994 Primeaux, II
5,423,339 A 6/1995 Latimer
5,447,389 A 9/1995 Olson
5,454,195 A 10/1995 Hallsten
5,549,418 A 8/1996 Devine et al.
5,553,971 A 9/1996 Osborne
5,586,586 A 12/1996 Feich
5,640,821 A * 6/1997 Koch ..... A47F 5/16 404/33
5,679,432 A 10/1997 Holmquest et al.
5,689,920 A 11/1997 Hallsten
5,742,992 A 4/1998 Kaempen
5,775,046 A * 7/1998 Fanger ..... A47B 81/06 108/157.16
5,800,091 A 9/1998 Van Romer
5,810,511 A 9/1998 Schmidt
5,814,693 A 9/1998 Priest et al.
5,833,392 A 11/1998 Youngs
5,882,142 A 3/1999 Siglin et al.
5,929,325 A 7/1999 Cartwright et al.
6,004,067 A 12/1999 Peppard
6,026,760 A 2/2000 Phillips et al.
6,089,781 A * 7/2000 Kellberg ..... F16B 1/0014 403/297
6,095,720 A 8/2000 Stark
6,238,137 B1 5/2001 Whitworth et al.
6,238,766 B1 5/2001 Massett et al.
6,291,019 B1 9/2001 Locke et al.
6,315,495 B1 11/2001 Sarheim
6,327,722 B1 12/2001 Noble
6,412,857 B2 7/2002 Jaekel et al.
6,431,387 B2 8/2002 Piehler
6,640,513 B2 * 11/2003 Ku ..... E04F 15/02 404/40
6,695,534 B2 2/2004 Cain et al.
6,841,111 B2 1/2005 Rickner et al.
6,854,926 B2 2/2005 Siglin et al.
6,939,080 B2 9/2005 Wokas
6,939,081 B1 9/2005 Gropp
7,014,391 B2 3/2006 Starheim et al.
7,021,019 B2 * 4/2006 Knauseder ..... E04F 13/10 24/297
7,171,994 B1 2/2007 O'Brien
7,255,055 B2 * 8/2007 Whybourne ..... B63B 3/08 114/263
7,267,288 B2 9/2007 Wheeler et al.
7,494,298 B2 2/2009 Perkins
7,500,592 B1 3/2009 Yaksic
7,574,834 B2 8/2009 Murray
7,614,825 B2 11/2009 Kroger
7,842,349 B2 11/2010 Raday et al.
7,946,439 B1 5/2011 Toscano et al.
7,950,191 B2 * 5/2011 Brouwers ..... E01C 5/20 15/161
7,967,164 B1 6/2011 Mountain
8,006,460 B2 * 8/2011 Chen ..... C04B 26/08 52/590.3
8,128,312 B2 * 3/2012 Stuchell ..... E01C 5/223 404/43
8,147,162 B1 * 4/2012 Burnett ..... F16B 5/0052 312/263
8,337,649 B2 12/2012 Baumgart et al.
8,733,057 B2 * 5/2014 Seitner ..... E04F 15/20 52/177
8,734,052 B2 5/2014 Perkins
8,925,264 B2 * 1/2015 Thrush ..... E04F 15/02016 52/177
9,010,067 B2 * 4/2015 Baker ..... E04F 15/04 52/391
9,326,622 B2 * 5/2016 Toth ..... A47G 1/16
9,346,584 B1 5/2016 Kokojan
9,410,302 B2 8/2016 Perkins et al.
2002/0055006 A1 5/2002 Vogel et al.
2002/0137871 A1 9/2002 Wheeler et al.
2004/0120769 A1 6/2004 Siglin et al.
2004/0134162 A1 7/2004 Douglas
2004/0217118 A1 11/2004 Nash
2005/0011899 A1 1/2005 Saitoh
2005/0058838 A1 3/2005 Markusch et al.
2005/0158131 A1 7/2005 Markusch et al.
2006/0027794 A1 2/2006 Heinz
2006/0057394 A1 3/2006 Cork
2006/0118563 A1 6/2006 Travis et al.
2006/0122320 A1 6/2006 Cahill et al.
2007/0102096 A1 5/2007 Dummett
2007/0208156 A1 9/2007 Posey et al.
2007/0208157 A1 9/2007 Posey et al.
2008/0003060 A1 1/2008 Perkins
2008/0047210 A1 2/2008 Bell
2008/0092730 A1 2/2008 Hall
2008/0127584 A1 6/2008 Schiffmann et al.
2008/0310920 A1 12/2008 Allen et al.
2009/0151791 A1 6/2009 Perkins
2009/0324335 A1 12/2009 Fossen et al.
2009/0324336 A1 12/2009 Fossen et al.
2010/0098371 A1 4/2010 Perkins et al.
2010/0140262 A1 6/2010 Whitener
2010/0216361 A1 8/2010 Bruchmann et al.
2016/0177529 A1 * 6/2016 Devine ..... E02D 27/02 52/292

FOREIGN PATENT DOCUMENTS

EP 1238926 A1 9/2002
EP 1514885 3/2005
GB 2320049 A 6/1998
WO WO 9416974 A1 8/1994

(56) References Cited

FOREIGN PATENT DOCUMENTS

| | | |
|---|---|---|
| WO | WO 2007136514 | 11/2007 |
| WO | WO 2008002988 A2 | 1/2008 |
| WO | WO 2008003120 | 1/2008 |

OTHER PUBLICATIONS

*Falcon Technologies and Services, Inc.* vs. *Benchmark Foam Inc.*, Complaint for Patent Infringement, Case No. 4:14-cv-00489, filed Jul. 30, 2014.
Dudley J. Primeaux II, "Polyurea Solves Temporary Issue," Polyurea Development Association, 2004, 1 pg.
Specification of VFI-210 (2105C80) Secondary Containment Membrane on Geotextile Over Earthen Surfaces, Update Sep. 1999, 4 pgs.
Geotextile Coatings, Primeaux Associates LLC, Undated, 1 pg.
Spraying over Geotextile, 2001, 2003, 2005 Primeaux Associates LLC, Rev. 03.05, 2 pgs.
General Standard: Polyurea / Geotextile Elastomeric Lining Systems, Polyurea Development Association, 2005, 21 pgs.
Markets and Applications for Spray Polyurea, http://polyureasystems.com/apps.htm (2005), 3 pgs.
The True Polyurea Spray Elastomer Story: Chemistry, Advances, and Applications, Primeaux and Hanson (Sep. 11, 2006), 21 pgs.
S-W polyurea helps in fight against, http://www.coastingsworld.com/contents/view/21465 (Aug. 11, 2005), 1 pg.
Versaflex Polyurea Sealants and Coatings: The Polyurea People; http://www.versaftex.com, Copyright 2003-2006, Accessed on Oct. 6, 2008, 2 pgs.
Sherwin-Williams, http://www.sherwin-williams.com/pro/index.jsp, Copyright 2006, Accessed Oct. 6, 2008, 1 pg.
Sherwin-Williams Envirolastic AR200 HD White, Sherwin-Williams Paints, Product Catalog, Undated, 1 pg.
Material Safety Data Sheet, B81V3300, The Sherwin-Williams Company, Mar. 17, 2009, 4 pgs.
S-W polyurea helps in fight against, http://www.coastingsworld.com/contents/view/21465 (Aug. 11, 2005), 6 pg.
Sherwin-Williams, http://www.sherwin-williams.com/pro/index.jsp, Copyright 2006, Accessed Oct. 9, 2017, 1 pg.
Versaflex Polyurea Sealants and Coatings: The Polyurea People; http://www.versaflex.com, Copyright 2003-2006, Accessed on Oct. 9, 2017, 6 pgs.
Smock, Doug, Polyureas are BOOMING in construction markets, Plastics World, May 1996, pp. 55-56, 2 pgs.
Heldon, Dan, Exploring High-Performance Polyurea Elastomers for Secondary Containment Coatings, Specialty Products, Inc., Tacoma, Washington, Paint & Coatings Industry, pp. 54-55, Aug. 1996, 2 pgs.
Potential Uses for Polyshield SS-100™ Spray Elastomers, Nov. 1996, Specialty Products, Inc., 6 pgs.

* cited by examiner

MULTI-PIECE STORAGE TANK PAD WITH SEPARATE CONNECTORS

PRIORITY CLAIM

This application is a non-provisional application claiming priority to provisional application for patent Ser. No. 62/157,906 filed on May 6, 2015, and entitled "Multi-Piece Storage Tank Pad With Separate Connectors," which is hereby incorporated by reference.

TECHNICAL FIELD

This disclosure relates in general to a support pad for a fluid storage tank, and more specifically to a multi-piece storage tank pad with separate connectors used to support storage tanks including storage tanks used in oilfield.

BACKGROUND

In the oil and gas industry, it is often necessary to store large quantities of fluids. The storage may be temporary or permanent. To store such fluids, above-ground tanks or vessels are erected. Such tanks are often supported by a base formed of cement, gravel, or other material. Construction of a gravel base may be time consuming and require such construction in advance of erecting or otherwise installing the tank. In addition, a gravel base may require the transport and handling of large quantities of gravel from a remote location to the tank site. Also, a gravel base may allow ground water and rain water to collect, which may cause the storage tank to rust or otherwise corrode, which threatens the structural integrity of the tank and may make leaks more likely. Tank leaks are detrimental to the production or disposal process and also to the environment.

SUMMARY

Embodiments disclosed include a multi-piece pad for supporting a storage tank, as might be found in oil and gas extraction or refining operations. The multi-piece pad includes a plurality of pad pieces where each pad piece has a core coated with a polymeric coating. Each pad piece also defines at least two connector receiving contours. Two pad pieces of the multi-piece pad are joined by a connector. In certain embodiments, the cores are formed from a material that allows the pad piece to be light weight in that it may be handled by hand by two individuals without additional lifting equipment. Each connector also has a core that is coated with the polymeric coating. Each connector is separate from the plurality of pad pieces, and each has a shape that corresponds to two adjacent connector receiving contours.

According to embodiments, the multi-piece pad includes four, six, eight, ten, or twelve pad pieces. Any suitable number of pad pieces may be joined to form a storage tank pad according to the present disclosure, and preferably an even number of tank pads. Outer pad pieces connect to two other pad pieces with two connectors, and inner pad pieces connect to three other pad pieces with three connectors. A portion of a perimeter of each pad piece forms part of a circumference of a circle when all the pad pieces are assembled.

According to one embodiment, the core is formed of an expanded polystyrene material and the coating is formed of a polyurea material that is applied by a thermal sprayer that coats the core with polyurea resin that cures to bond with the core to form an impermeable outer shell.

Technical advantages of tank pads with separate connectors according to the teachings of the present disclosure include tank pads that are easier to bundle and ship than tank pads with integral connector portions. Also, the surface area at the interface of the connector and the individual tank pad pieces allow for drainage between the two pieces.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

DETAILED DESCRIPTION

Figure 1A:
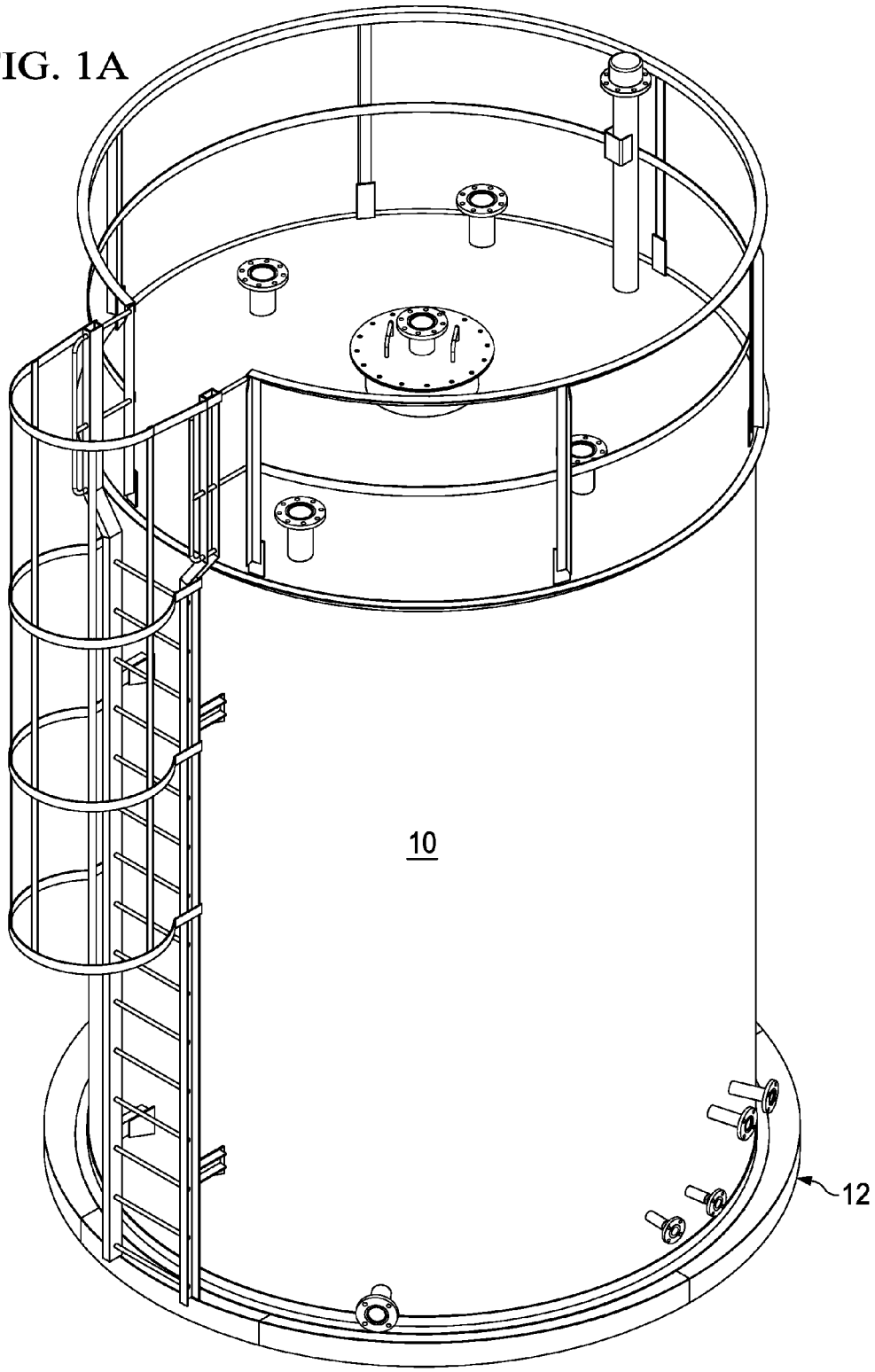
FIGS. 1A and 1B are environmental views of a storage tank supported by a multi-piece tank pad with separate connectors according to the teachings of the present disclosure.
Figure 1B:
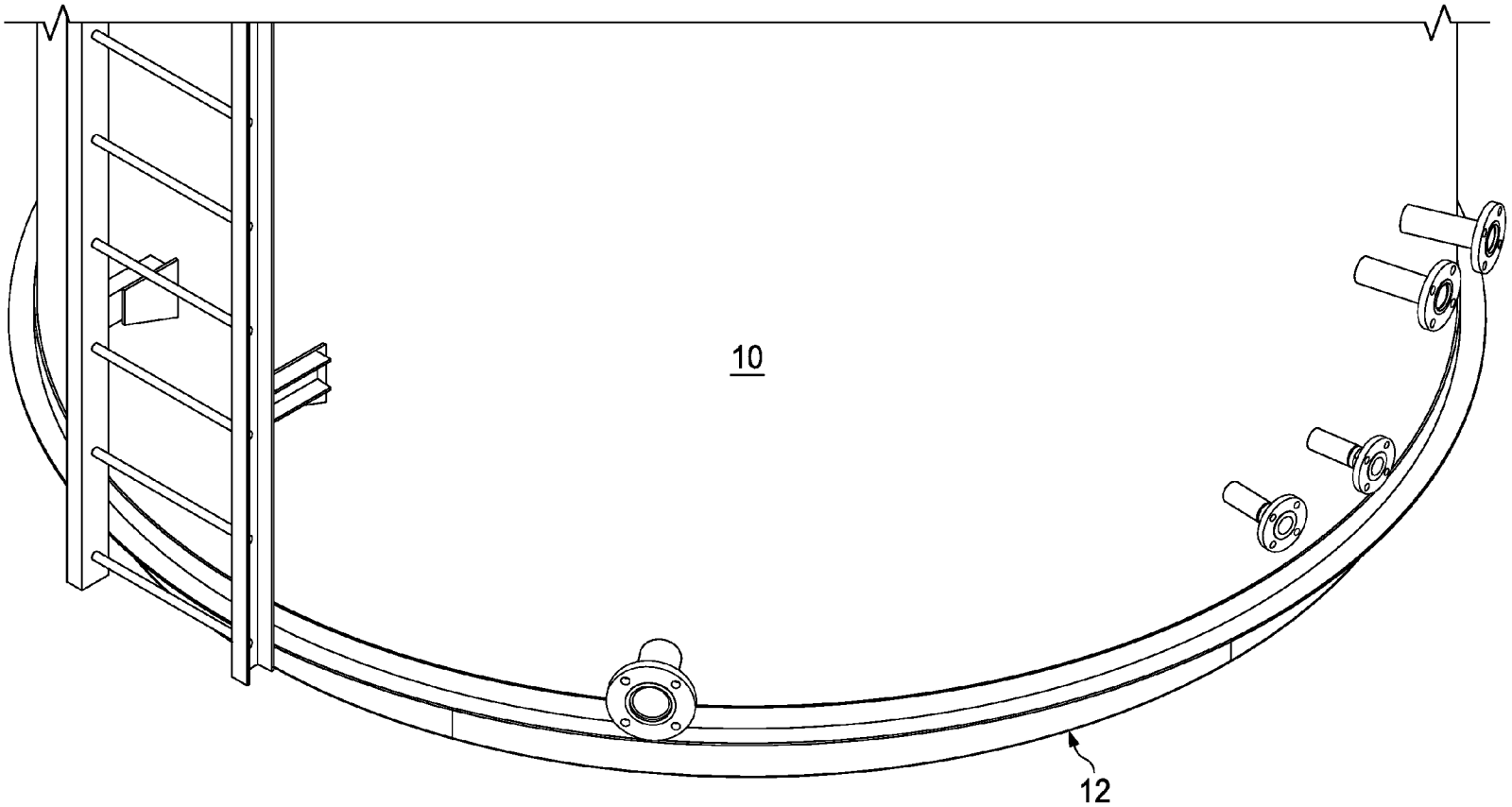

FIGS. 1A and 1B are environmental views of a storage tank 10, which may also referred to as an oilfield storage tank 10 supported by a multi-piece tank pad 12 with separate connectors according to the teachings of the present disclosure. The multi-piece tank pad 12 supports the storage tank 10 above ground level, so that the bottom of the tank is elevated and not resting on the earth where it may be exposed to ground water and other corrosive elements. The oilfield storage tank 10 may be used to store oil, natural gas, fresh water, waste water, water used in hydraulic fracturing operations, gasoline, diesel fuel or any other material associated with oil and gas production that requires storage associated with special processing either to refine into a usable petroleum product or for further processing for environmentally safe disposal.

The storage tank 10 may be any size and shape. Some common sizes of oilfield storage tanks are diameters of ten feet, twelve feet, fifteen-and-half feet, and twenty-one-and-a-half feet. FIG. 1A shows a storage tank 10 with a diameter of a lower portion that is less than a diameter of the multi-piece tank pad 12. FIG. 1B shows a lower portion of a storage tank 10 with a diameter of the lower portion that is greater than a diameter of the multi-piece tank pad 12. According to the smaller diameter tank pad 12 embodiment shown in FIG. 1B, the tank pad 12 may be better protected from water accumulation because drainage descending from the side surfaces of the storage tank 10 drips off the storage tank 10 onto the ground where it can be received by one or more ground drains.

Figure 2:
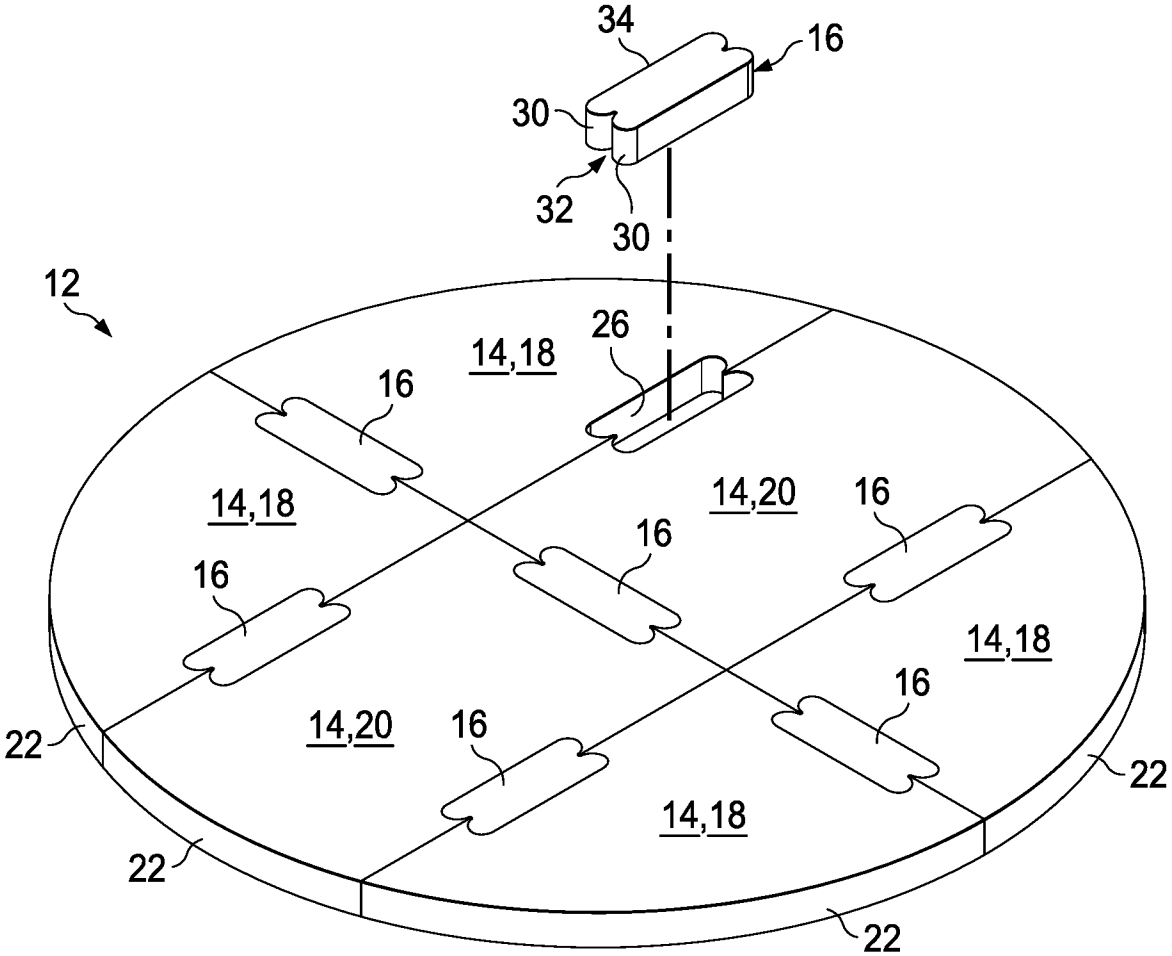
FIG. 2 is a perspective view of the multi-piece tank pad of FIG. 1 showing six individual pieces and separate connectors.

FIG. 2 is a perspective view of a multi-piece pad 12 assembled to support a storage tank 10 according to the teachings of the present disclosure. The tank pad 12 is formed by connecting multiple pieces together to form a large circular pad with a thickness of approximately four to eighteen inches, but any suitable thickness is contemplated by this disclosure. The tank pad 12 shown in FIG. 2 is formed from six pad pieces 14 joined to each other by seven connectors 16, where each connector 16 is separate from the pad pieces 14.

Each tank pad piece 14 and each connector 16 of the multi-piece storage tank pad 12 is light weight so that it may be easily handled in transport and during assembly at the tank site. The individual pad pieces 14 and the connectors 16 are made of a core formed of sturdy light weight material that is coated with a polymeric coating. For example, the core may be formed of an extruded foam, such as an extruded polystyrene, an expanded foam, such as an expanded polystyrene material or similar strong, light weight material. According to certain embodiments, the core is formed of extruded polystyrene with a two pound density. In another embodiment, the density of the extruded polystyrene may have a density of three pounds.

In other embodiments, the light weight material may be a polymer with a foaming agent, a honeycomb material, an aerated polymer, a closed cell foam, an open cell foam, or a urethane. The coating may be a polyurea that is sprayed onto the core using a thermal spray system. The light weight material allows at most two individuals to move and position by hand a single pad piece, and in other embodiments a single individual may be able to handle and position a single pad piece.

The coating may be any suitable coating to coat and bond with the core material to seal the voids of the core from the ambient surroundings. Once cured, the coating bonds to the core and creates an impermeable shell covering the core. The coating may be paint, polyurethane, polyurea, thermoset, thermoplastic, epoxy, and the like. In one embodiment, the coating is a polymeric coating that is marketed under the trade name Ecodur 201 and provided by Castagra Products, Inc. of Reno, Nev. According to certain embodiments, the cured polymeric coating may have a thickness in the range of 40 to 80 mils.

In the illustrated embodiment, the multi-piece storage tank pad 12 is formed of four outer pad pieces 18 and two inner pieces 20. Each one of the outer pieces 18 and the inner pieces 20 includes an arcuate perimeter surface 22 that forms part of the overall circular perimeter of the multi-piece tank pad 12 when the pieces are joined together. Each outer pad piece 18 connects to another outer pad piece 18 and to one inner pad piece 20. Two inner pieces 20 connect to each other and each inner pad piece 20 connects to an outer pad piece 18 on each side of the inner pad piece 20.

To join the pieces 14, each individual pad piece 14 is positioned adjacent to another piece 14 such that respective connector-receiving contours 24 together form a connector-receiving cutout 26. Once two pieces are in position, a connector 16 may be received by the connector-receiving cutout 26 to join the two pieces 14.

Figure 3:
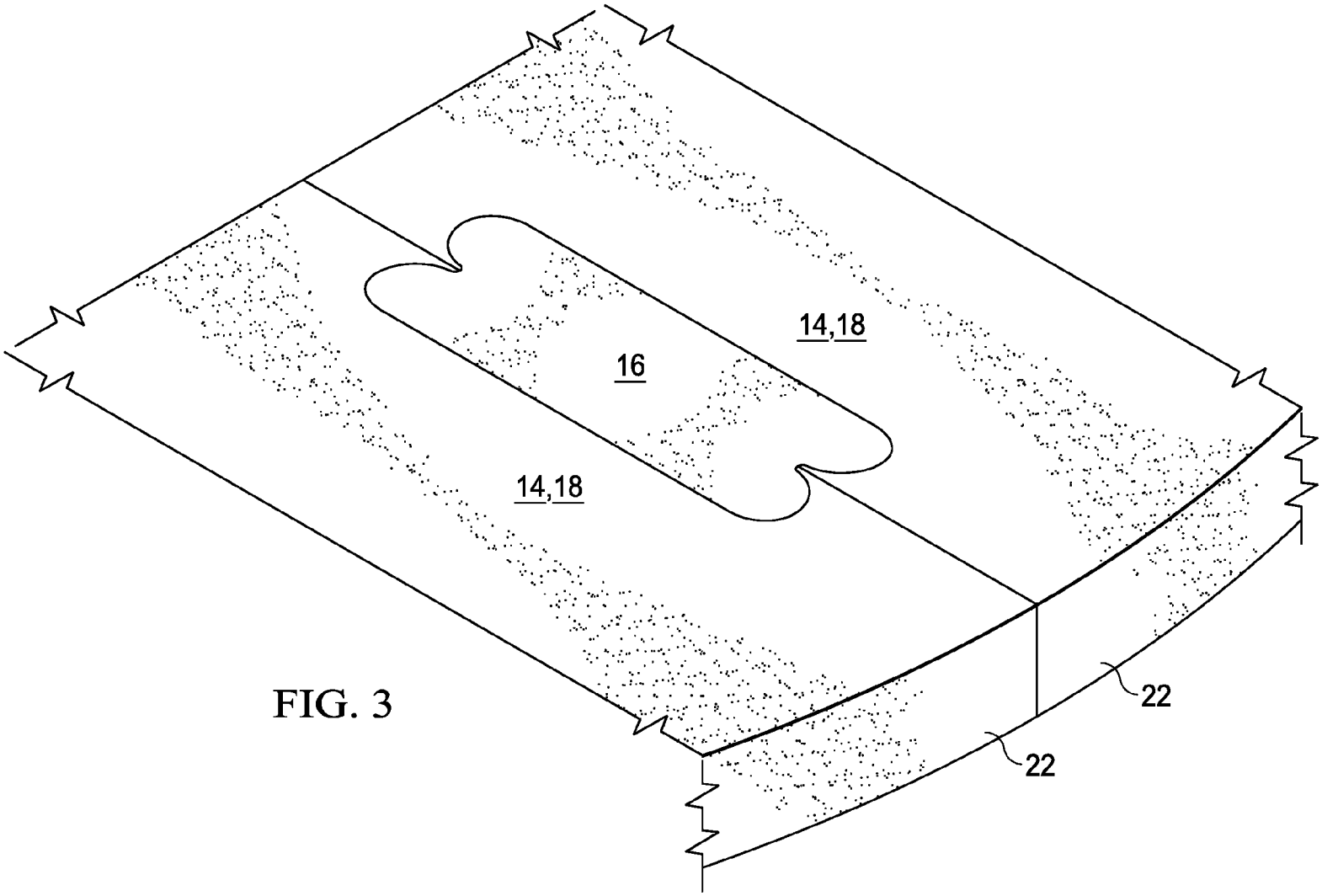
FIG. 3 is a detailed perspective view of a connection of adjacent tank pad pieces using a connector.
Figure 4:
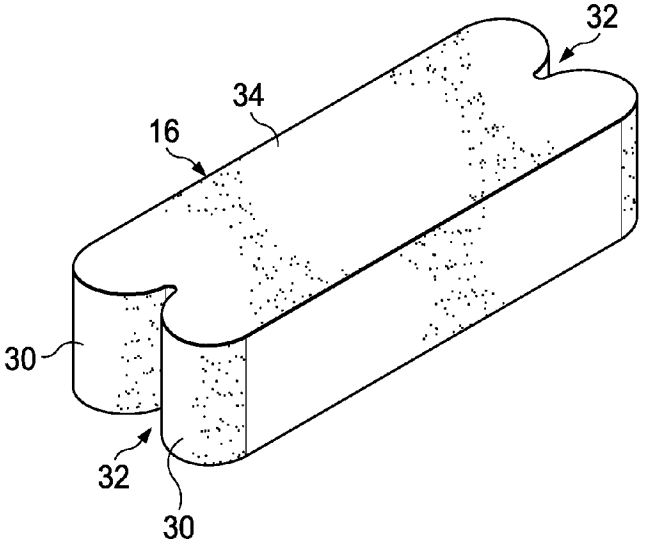
FIG. 4 is a perspective view of a connector.
Figure 5:
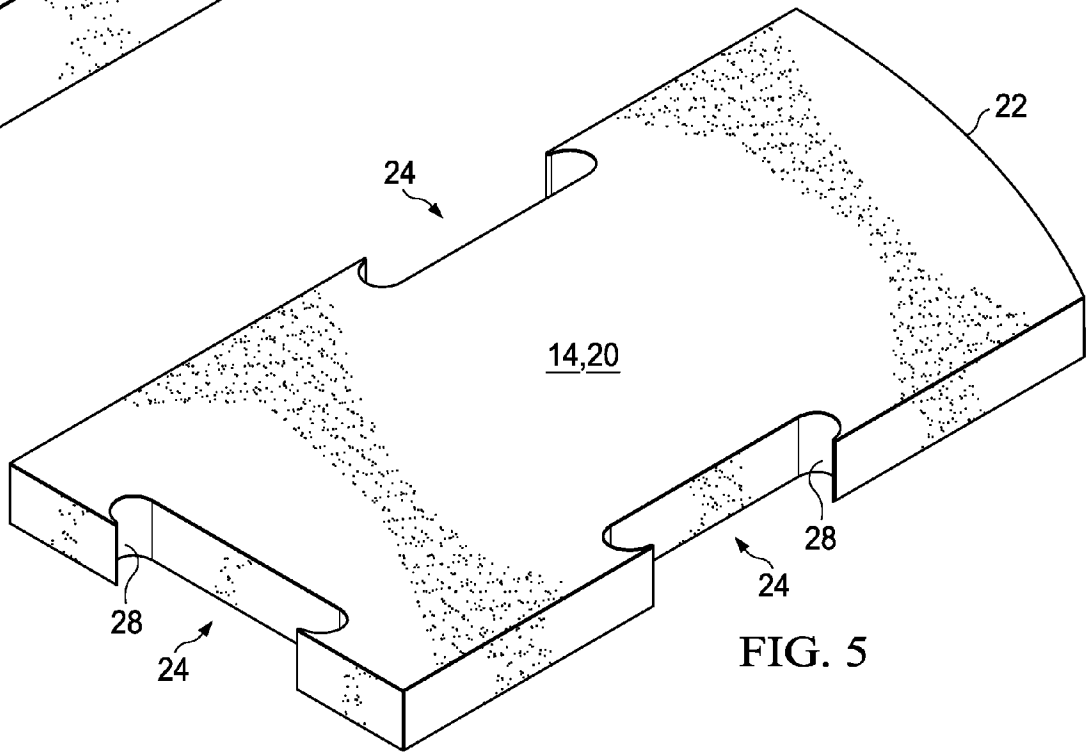
FIG. 5 is a perspective view of an individual inner tank pad piece showing three perimeter connector receiving contours.

Reference is now made to FIGS. 3-5. FIG. 3 is a detail perspective view of a connection between two outer pad pieces 18 with a connector 16. FIG. 4 is a perspective view of a single connector 16. FIG. 5 is a perspective view of a single tank pad piece 14, specifically an inner tank pad piece 20. Each connector-receiving contour 24 includes a concave contour 28 on a first end and another concave contour 28 on a second end. The concave contours 28 receive corresponding convex connector surfaces 30 of the connector 16 when the tank pad pieces are joined. The connector 16 includes a notch 32 disposed between two adjacent convex connector surfaces 30. The notch 32 receives a portion of each of two adjacent pad pieces 14. According to an alternate embodiment, the notch 32 may receive portions of the pad pieces that are more rounded than illustrated. As discussed in more detail below, the polymeric coating may coat rounded surface better than sharp corners.

Once in position, the connector 16 constrains movement of individual adjacent tank pad pieces 14 with respect to each other. The connector 16 generally has a thickness equal to the thickness of the tank pad pieces 14 such that a top surface 34 of the connector is flush with the top surfaces of the tank pad pieces 14. According to certain embodiments, the arcuate surfaces of the concave contour 28 of the tank pad pieces 14 and the convex connector surface 30 of the connector 16 allow tenacious bonding of the polymeric coating, such as polyurea. The coating bonds to and completely coats rounded surfaces better than sharp corner-type surfaces. As such, the coating may better prevent liquid from reaching the voids of the core and being absorbed and retained by such voids in the material of the core.

According to an embodiment of the present disclosure, all connectors 16 for a particular multi-piece pad 12 are the same size and shape such that any connector 16 can be received by any connector-receiving cutouts 26 in adjacent pad pieces 14. Although the connectors 16 and the corresponding connector receiving cutouts 26 are illustrated symmetrical, the present disclosure contemplates non-symmetrical connectors 16 and connector receiving cutouts 26. Also, the connector receiving cutouts 26 need not extend the full thickness of the pad piece 14. Similarly, the connector 16 may have a thickness that is less than the thickness of the pad piece 14, and the top surface 34 of the connector 16 may or may not be flush with the top surface of the pad pieces 14.

FIG. 5 illustrates an inner tank pad piece 20. One of the perimeter surfaces is an arcuate perimeter surface 22, and the other three perimeter surfaces define connector-receiving contours 24. Thus, the inner pad piece 20 connects to three other tank pad pieces 14 in assembling the tank pad 12. The connector-receiving contours 24 may comprise any suitable percentage of the perimeter sides of an individual tank pad piece 14. For example, the connector-receiving contour 24 of the shorter perimeter side occupies over 50% of the overall length of the shorter perimeter side. For the longer side of the tank pad piece 14, 20, shown in FIG. 5, the connector-receiving contour 24 occupies in a range of 25%-35% of the length of the longer perimeter side of the tank pad piece 20. Accordingly, connector-receiving contours 24 configured to receive a correspondingly sized connector 16 may have an approximate length to occupy from 25%-75% of a length of a perimeter side of a tank pad piece 14.

With continued reference to FIG. 5, the perimeter sides including the arcuate perimeter side 22 are disposed in a generally rectangular shape with the connector receiving contours 24 extending inward of the peripheral sides. This configuration of a tank pad piece 14, 20 facilitates bundling and shipping of the tank pad pieces 14. In contrast, a tank pad piece with an integrated connector will have one or more sides with a connector portion extending outward from a perimeter side. This extending integrated connector portion may complicate bundling and shipping of tank pad pieces. The multi-piece tank pad with separate connectors of the present disclosure ameliorates this issue by allowing the connectors to be separate from the tank pad pieces 14, so the connectors 16 can be separately bundled and located separate from the tank pad pieces 14 on a shipping vehicle, such as a semi-trailer truck.

The six piece tank pad 12 shown in FIG. 2 may have an overall diameter of approximately 10 feet, and therefore supports an oil-field storage tank 10 that is substantially 10 feet in diameter. In certain embodiments, the diameter of the oil field storage tank 10 may be slightly greater (FIG. 1B) or slightly less (FIG. 1A) than the diameter of the assembled multi-piece storage tank pad 12. Consistent with the discussion above regarding the connector-receiving contours 24, a diameter of the assembled tank pad 12 shown in FIG. 2 is defined by the junction of three tank pieces 14 with a second set of three tank pieces 14. As such, each junction of two tank pieces 14 includes a pair of connector-receiving contours 24 that form a connector-receiving cutout 26. The portion of the diameter occupied by the connector-receiving cutouts 26, and thus the connectors 16 may be 35-65% of the total diameter of the circular assembled tank pad 12.

Figure 6:
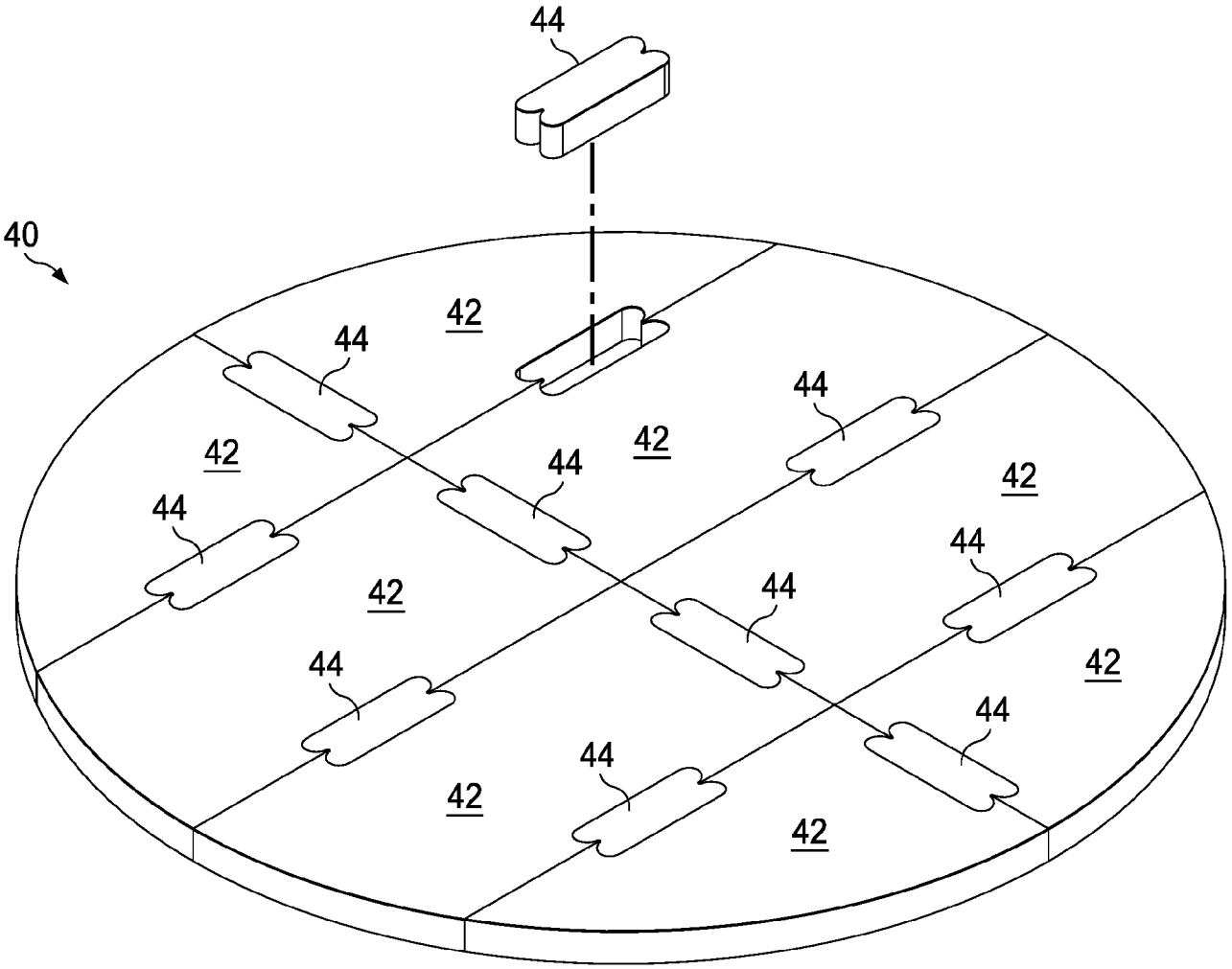
FIG. 6 is a perspective view of a multi-piece tank pad formed of eight individual tank pad pieces and separate connectors.

Reference is made to FIG. 6, which is a perspective view of an eight piece oil field storage tank pad 40. The assembled eight piece oil field storage tank pad 40 has a diameter of approximately twelve feet, and therefore supports an oilfield storage tank with a diameter of approximately twelve feet. Similar to the six piece embodiment, the eight piece embodiment can support an oil-field storage tank with a diameter slightly greater or slightly less than twelve feet. The pieces 42 and the connectors 44 are generally shaped similar to that described with respect to FIGS. 2-5 with the exception that the dimensions of the individual pieces 42 and connectors 44 are sized to form a twelve foot diameter multi-piece tank pad 40 when assembled.

Figure 7:
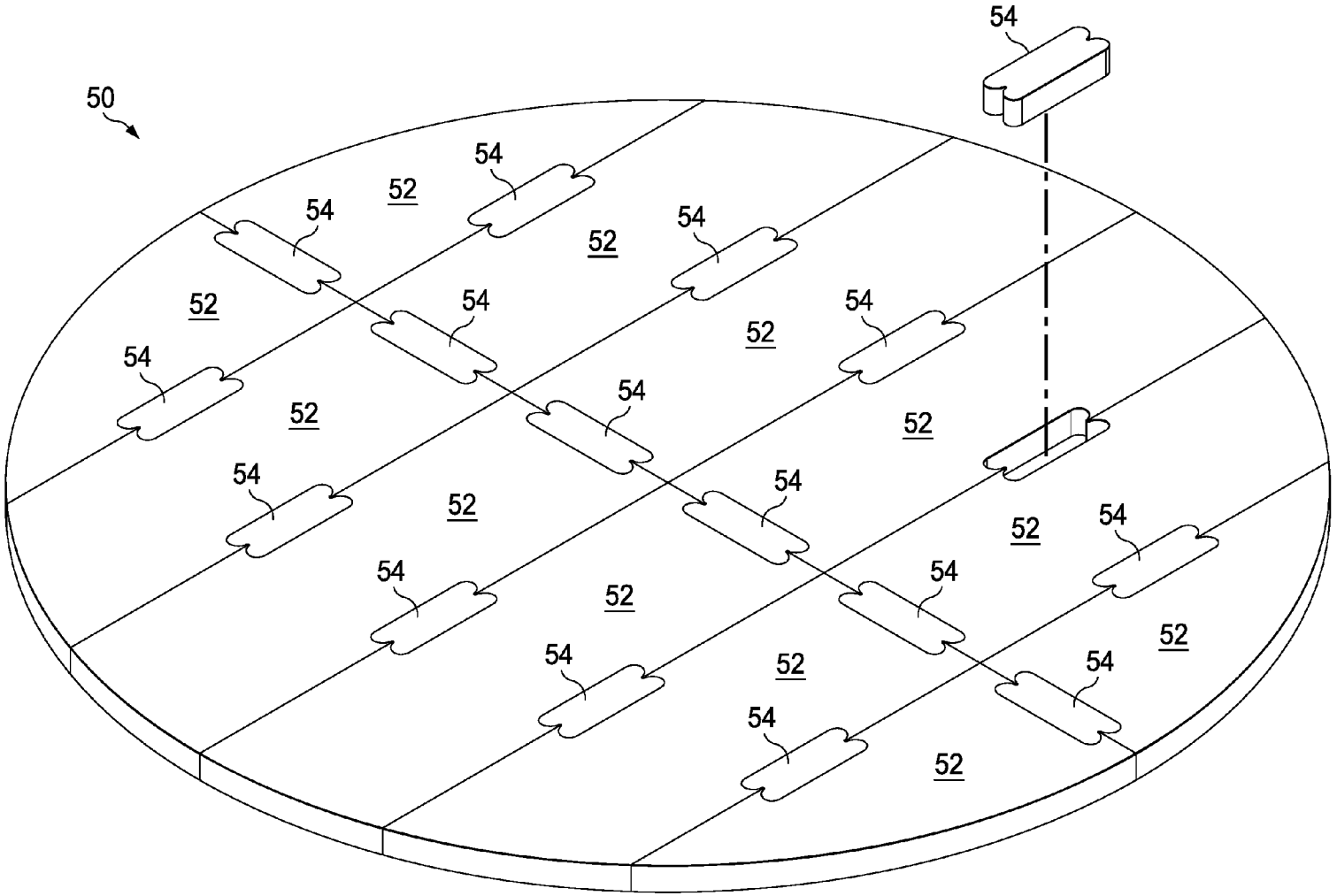
FIG. 7 is a perspective view of a multi-piece tank pad formed of twelve individual tank pad pieces and separate connectors.

Reference is made to FIG. 7, which illustrates a perspective view of a twelve piece multi-piece oil field tank pad 50. The twelve piece oil field tank pad 50 has a diameter of approximately sixteen feet. As such, the twelve piece oil field tank pad 50 is configured to support a storage tank that is substantially sixteen feet in diameter. Similar to the other embodiments, the twelve piece oil field tank pad 50 can support a storage tank that has a diameter slightly larger or slightly less than sixteen feet. The pieces 52 and the connectors 54 are generally shaped similar to that described with respect to FIGS. 2-5 with the exception that the dimensions of the individual pieces 52 and connectors 54 are sized to when assembled form a sixteen foot diameter multi-piece tank pad 50.

One skilled in the art will recognize that the multi-piece oil field tank pad is not limited to the particular number of pieces disclosed in the illustrated embodiments, but rather any suitable number of pieces and connectors may be joined to form any diameter tank pad, as required.

According to the teachings of the present disclosure, a multi-piece tank pad 12 may be assembled with six or more pieces that are dimensionally sized to easily be transported and handled at a tank construction site. Similarly, the individual pieces 14 and connectors 16 are easily handled by assemblers at the worksite. The single-sized connector 16 simplifies assembly such that any connector 16 may be fit to join any two adjacent tank pad pieces 14.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below," "top" and "bottom" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A multi-piece pad for supporting a storage tank, the multi-piece pad comprising:

a plurality of pad pieces, each pad piece having a core coated with a polymeric coating and each pad piece defining at least two connector receiving contours;

a plurality of connectors, each connector having a core coated with the polymeric coating and each being separate from the plurality of pad pieces, the plurality of connectors having a first end and a second end disposed longitudinally opposite the first end, each end having a plurality of convex surfaces and a notch disposed therebetween that receives a portion of each of a pair of adjacent pad pieces to limit movement of one adjacent pad piece with respect to the other adjacent pad piece;

wherein the plurality of pad pieces comprises a plurality of inner pad pieces and a plurality of outer pad pieces, each outer pad piece connecting to at least two adjacent pad pieces and each inner pad piece connecting to at least three adjacent pad pieces; and wherein the plurality of pad pieces and the plurality of connectors form a circular assembled multi-piece pad and each outer pad piece includes an arcuate surface forming a portion of a perimeter of the circular assembled multi-piece pad.

2. A multi-piece pad for supporting a storage tank, the multi-piece pad comprising:

a plurality of pad pieces, each pad piece having a core coated with a polymeric coating and each pad piece defining at least two connector receiving contours;

a plurality of connectors, each connector having a core coated with the polymeric coating and each being separate from the plurality of pad pieces, the plurality of connectors having a first end and a second end disposed longitudinally opposite the first end, each end having a plurality of convex surfaces and a notch disposed therebetween that receives a portion of each of a pair of adjacent pad pieces to limit movement of one adjacent pad piece with respect to the other adjacent pad piece;

wherein the plurality of pad pieces comprises a plurality of inner pad pieces and a plurality of outer pad pieces, each outer pad piece connecting to at least two adjacent pad pieces and each inner pad piece connecting to at least three adjacent pad pieces;

wherein the plurality of pad pieces and the plurality of connectors form a circular assembled multi-piece pad that is configured to support a storage tank having a diameter of at least ten feet; and wherein a diameter of the circular assembled multi-piece pad is less than the diameter of the storage tank.

3. An assembly comprising:

a pad that includes:

a plurality of pad pieces having a core coated with a polymeric coating and each of the plurality of pad pieces defining at least two connector receiving contours;

a plurality of connectors having a core coated with the polymeric coating separate from the plurality of pad pieces, the plurality of connectors having a first end and a second end disposed longitudinally opposite the first end, each end defining a plurality of convex surfaces and a notch therebetween, the notch configured to receive a portion of adjacent pad pieces to limit movement of one adjacent pad piece with respect to the other adjacent pad piece; and wherein the plurality of pad pieces and the plurality of connectors form a circular assembled multi-piece pad, and the plurality of pad pieces include an arcuate surface forming a portion of a perimeter of the circular assembled multi-piece pad, a storage tank supported by the pad, wherein a diameter of the circular assembled multi-piece pad is less than the diameter of the storage tank.

4. The assembly of claim 3 wherein the core is an expanded polystyrene material and the coating is a polyurea material.

5. The assembly of claim 3 wherein more portions of connectors are disposed on a line bisecting the circular assembled multi-piece pad than portions of pad pieces disposed on the line.

6. The assembly of claim 3 wherein the core is a urethane material and the coating is a polymer material.

7. The assembly of claim 3 wherein the core is a closed cell foam material and the coating is a polymer material.

8. The assembly of claim 3 wherein the core is a honeycomb material and the coating is a polymer material.

* * * * *